US005830022A

United States Patent [19]

Nakase et al.

[11] Patent Number: 5,830,022

[45] Date of Patent: Nov. 3, 1998

[54] CATALYTIC EXHAUST SYSTEM FOR WATERCRAFT

[75] Inventors: Ryoichi Nakase; Shigeyuki Ozawa; Keiichi Hiki, all of Shizuoka, Japan

[73] Assignee: Yamaha Hatsudoki Kabushiki Kaisha, Japan

[21] Appl. No.: 788,648

[22] Filed: Jan. 24, 1997

[30] Foreign Application Priority Data

Jan. 26, 1996 [JP] Japan ..... 8-011909

[51] Int. Cl.[6] ..... B63H 21/10

[52] U.S. Cl. ..... 440/88; 440/89

[58] Field of Search ..... 60/295, 297, 298, 60/299, 301, 302; 440/89, 88

[56] References Cited

U.S. PATENT DOCUMENTS

| | | | |
|---|---|---|---|
| 4,664,054 | 5/1987 | Nishida . | |
| 4,735,046 | 4/1988 | Iwai | 60/295 |
| 4,773,883 | 9/1988 | Nakase et al. . | |
| 4,811,560 | 3/1989 | Nakase et al. . | |
| 4,900,282 | 2/1990 | Takahashi et al. . | |
| 4,982,682 | 1/1991 | Hattori . | |
| 4,989,409 | 2/1991 | Nakase et al . | |
| 4,997,399 | 3/1991 | Nakayasu et al. . | |
| 5,014,510 | 5/1991 | Laimbock | 60/299 |
| 5,067,448 | 11/1991 | Nakase et al. . | |
| 5,096,446 | 3/1992 | Tazaki et al. . | |
| 5,174,112 | 12/1992 | Sougawa et al. . | |
| 5,234,364 | 8/1993 | Ito . | |
| 5,251,439 | 10/1993 | Nakase et al. . | |
| 5,280,708 | 1/1994 | Nakase et al. . | |
| 5,324,217 | 6/1994 | Mineo . | |
| 5,346,417 | 9/1994 | Isogawa | 440/89 |
| 5,366,401 | 11/1994 | Nanami et al. . | |
| 5,408,827 | 4/1995 | Holtermann et al. . | |
| 5,511,505 | 4/1996 | Kobayashi et al. . | |
| 5,536,189 | 7/1996 | Mineo . | |
| 5,546,748 | 8/1996 | Iwai et al. . | |
| 5,562,509 | 10/1996 | Nakase et al. . | |

FOREIGN PATENT DOCUMENTS

| | | |
|---|---|---|
| 2-256814 | 10/1990 | Japan . |

*Primary Examiner*—Stephen Avila

*Attorney, Agent, or Firm*—Knobbe, Martens, Olson & Bear, LLP

[57] ABSTRACT

An improved catalytic exhaust system for a watercraft provides two stage treatment of exhaust gases before expulsion from the watercraft. The catalytic exhaust system also is configured to minimize the restriction the catalysts pose to exhaust gas flow through the exhaust system so as to reduce engine back pressure and improve engine performance. A catalytic device of the exhaust system includes a pre catalyst and a main catalyst positioned downstream from the pre catalyst. The pre catalyst can take the from of a catalytic material coating along a portion of the exhaust flow path and the main catalyst can be a catalyst bed. The exhaust gas flow path through the exhaust system also smoothly tapers into and out of the main catalyst so as to reduce the degree of flow resistance through the main catalyst.

20 Claims, 5 Drawing Sheets

CATALYTIC EXHAUST SYSTEM FOR WATERCRAFT

BACKGROUND OF THE INVENTION

1. Field of the Invention

The present invention relates to an exhaust system for a watercraft, and more particularly to a catalytic exhaust system of a watercraft.

2. Description of Related Art

Personal watercraft have become very popular in recent years. This type of watercraft is quite sporting in nature and carries a rider and possibly one or two passengers. A relatively small hull of the personal watercraft commonly defines a riders' area above an engine compartment. A two-cycle internal combustion engine frequently powers a jet propulsion unit which propels the watercraft. The engine lies within the engine compartment in front of a tunnel formed on the underside of the watercraft hull. The jet propulsion unit is located within the tunnel and is driven by a drive shaft. The drive shaft usually extends between the engine and the jet propulsion device, through a wall of the hull tunnel.

An exhaust system of the personal watercraft discharges engine exhaust to the atmosphere either through or close to the body of water in which the watercraft is operating. Although submerged discharge of engine exhaust silences exhaust noise, environmental concerns arise. These concerns are particularly acute in connection with two-cycle engines because engine exhaust from two-cycle engines often contains lubricants and other hydrocarbons.

Such environmental concerns have raised a desire to minimize exhaustion of hydrocarbons and other exhaust byproducts (e.g., carbon monoxide and oxides of nitrogen), and thus reduce pollution of the atmosphere and the body of water in which the watercraft is operated. In response to the increased concerns regarding exhaust emissions, some personal watercraft engines recently have become equipped with a catalyst to convert exhaust byproducts to harmless gases.

Catalysts must operate at a relatively high temperature in order to produce the necessary thermal reaction and burning of the exhaust byproducts. A catalytic device thus desirably operates within a specific range of temperature so as to effectively and efficiently convert engine exhaust into generally harmless gases.

Some prior exhaust systems have employed a cooling jacket about the catalytic device to maintain the catalytic device within the desired temperature range. In some systems, at least a portion of the cooling water also is introduced into the exhaust system to not only further cool and silence the exhaust gases, but also to assist the discharge of exhaust gases. The added water to the exhaust system, however, gives rise to possible damage to the catalyst.

The sporting nature of the personal watercraft makes it likely that water occasionally will flow upstream from the point of introduction in the exhaust system toward the catalytic device, especially if the watercraft becomes inverted and is subsequently righted. As noted above, the catalyst must operate at a high temperature relative to the cooling water in order to produce the necessary thermal reaction and burning of exhaust byproducts. If a significant amount of water comes in contact with the catalyst, the catalyst can become polluted and thereafter function poorly as a catalyst, particularly when coated by salt deposits from salt water. The contact between the high-temperature catalytic device and relatively cool water also may even cause the catalyst to shatter.

SUMMARY OF THE INVENTION

One aspect of the present invention involves a watercraft that comprises an internal combustion engine. The internal combustion engine includes at least one exhaust port and an output shaft which drives a propulsion device of the watercraft. An exhaust system of the watercraft includes an exhaust passage that extends between the engine exhaust port and a discharge port so as to discharge exhaust gases from the engine to the atmosphere, either directly or through the water in which the watercraft is operated. A catalytic device of the exhaust system treats exhaust gases before discharge through the discharge port. For this purpose, the catalytic device including a main catalyst and a pre catalyst which is arranged within the exhaust passage apart from and upstream of the main catalyst. A cooling jacket extends along a portion of the exhaust system in the vicinity of the catalytic device to cool the catalytic device. The cooling jacket opens into the exhaust passage at a point downstream of the main catalyst to introduce cooling water into the exhaust gas flow for silencing purposes.

The catalytic device improves the treatment of the exhaust gases over prior systems by the use of a pre catalyst in combination with the main catalyst. The two stage treatment process not only improves the efficacy of the catalytic device, but also adds redundancy to the system should one of the catalysts fail or become polluted.

The cooling jacket desirably includes an outlet port located upstream of the merger point between the cooling jacket and the exhaust passage. At least a portion of the coolant passing through the cooling jacket flows through the outlet port into a discharge line for expulsion overboard. In this manner, the likelihood of a significant back-flow of coolant into the catalytic device is reduced.

BRIEF DESCRIPTION OF THE DRAWINGS

These and other features of the invention will now be described with reference to the drawings of preferred embodiments of the exhaust system. The different embodiments of the invention are intended to illustrate and not to limit the invention. To assist the reader's understanding of the description of the embodiments which follow, the following provides a brief description of the referenced drawing.

DETAILED DESCRIPTION OF PREFERRED EMBODIMENTS

Several embodiments of the catalytic exhaust system are disclosed herein. Each of these embodiments employ the same basic concepts characteristic of the improved features of the exhaust system, namely a redundant catalyst system located upstream of a merger point between the exhaust gas flow and a portion of the cooling water for the exhaust system.

Figure 1:
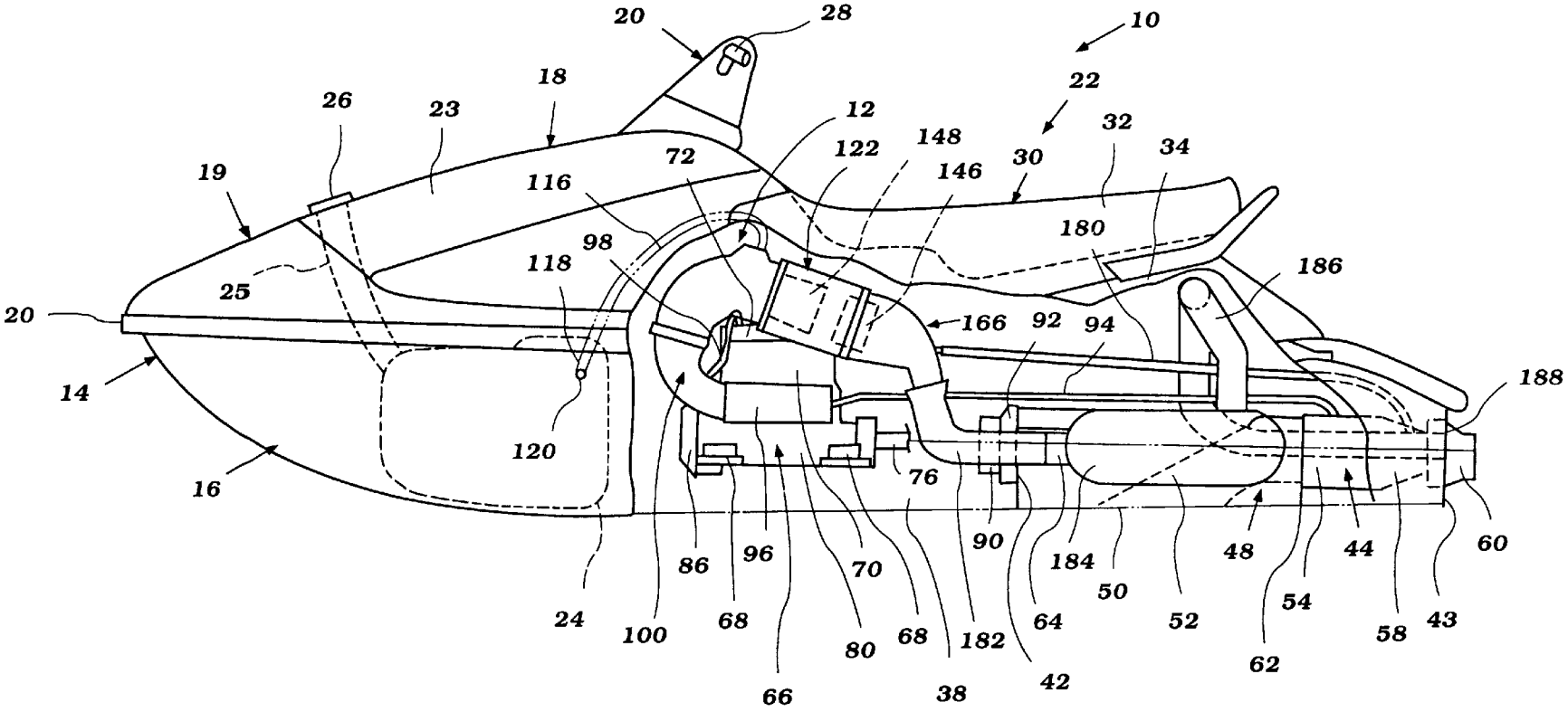
FIG. 1 is a partial sectional, side elevational view of a personal watercraft including an exhaust system configured in accordance with a preferred embodiment of the present invention.
Figure 2:
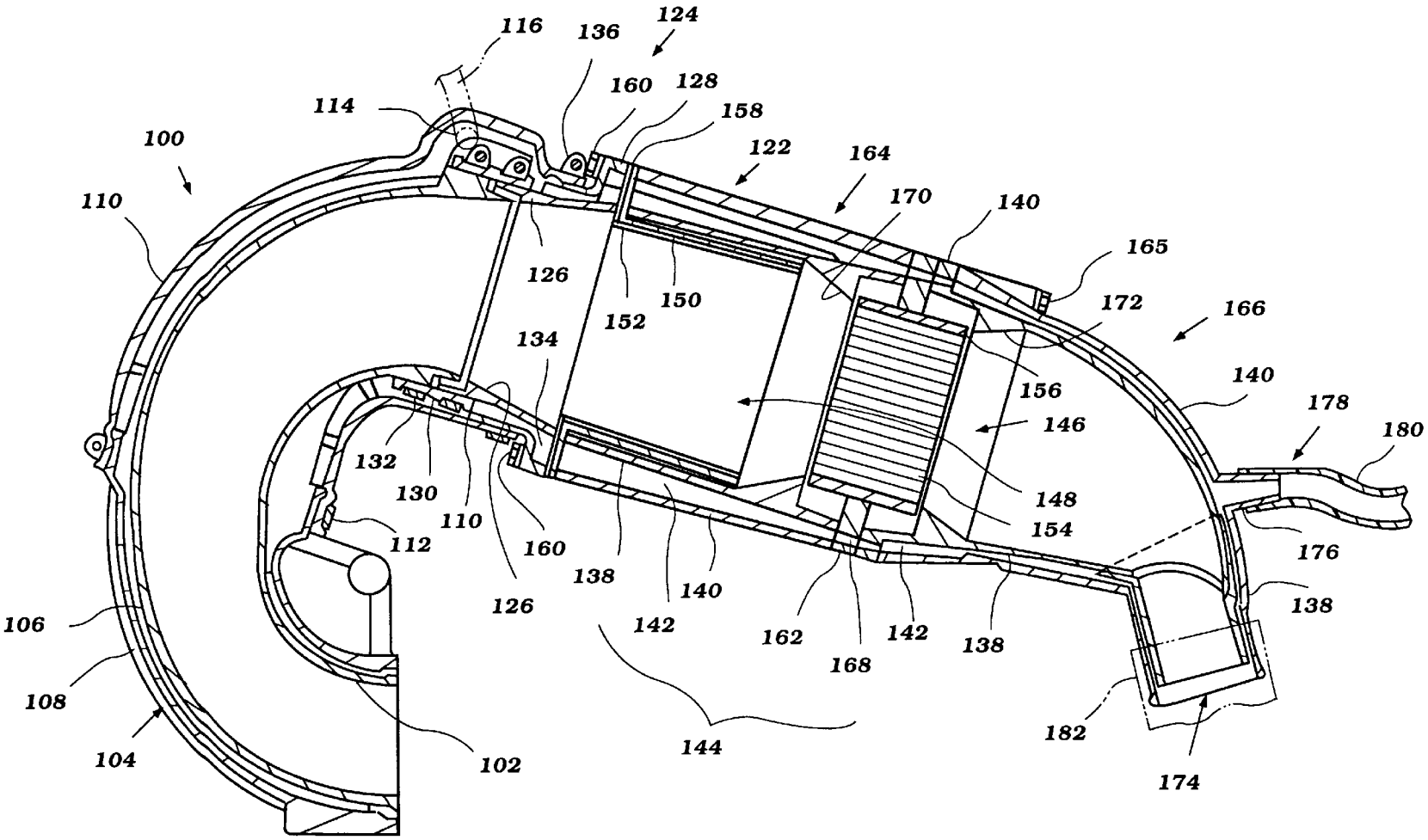
FIG. 2 is an enlarged cross-sectional view of a portion of the exhaust system of FIG. 1.

FIGS. 1 and 2 illustrate a personal watercraft 10 which includes an exhaust system 12 configured in accordance with a preferred embodiment of the present invention. Although the present exhaust system 12 is illustrated in connection with a personal watercraft, the catalytic exhaust system can be used with other types of watercraft as well, such as, for example, but without limitation, small jet boats and the like.

Before describing the exhaust system 12, an exemplary personal watercraft 10 will first be described in general details to assist the reader's understanding of the environment of use and the operation of the exhaust system 12. The watercraft 10 includes a hull 14 formed by a lower hull section 16 and an upper deck section 18. The hull sections 16, 18 are formed from a suitable material such as, for example, a molded fiberglass reinforced resin. The lower hull section 16 and the upper deck section 18 are fixed to each other around the peripheral edges 20 in any suitable manner.

As viewed in the direction from the bow to the stem of the watercraft, the upper deck section 18 includes a bow portion 19, a control mast 20 and a rider's area 22. The bow portion 19 slopes upwardly toward the control mast 20 and includes at least one air duct through which air can enter the hull. A cover 23 desirably extends above an upper end of the air duct to inhibit an influx of water into the hull.

A fuel tank 24 is located within the hull 14 beneath the cover 23. Conventional means, such as, for example, straps, secure the fuel tank 24 to the lower hull 16. A fuel filler hose 25 extends between a fuel cap assembly 26 and the fuel tank 24. In the illustrated embodiment, the filler cap assembly 26 is secured to the bow portion 19 of the hull upper deck 18 to the side and in front of the control mast 20. In this manner, the fuel tank can be filled from outside the hull 14 with the fuel passing through the fuel filler hose 25 into the tank 24.

The control mast 20 extends upward from the bow portion 19 and supports a handlebar assembly 28. The handlebar 28 controls the steering of the watercraft 10 in a conventional manner. The handlebar assembly 28 also carries a variety of controls of the watercraft 10, such as, for example, a throttle control, a start switch and a lanyard switch.

The rider's area 22 lies behind the control mast 20 and includes a seat assembly 30. In the illustrated embodiment, the seat assembly 30 has a longitudinally extending straddle-type shape that may be straddled by an operator and by at least one or two passengers. The seat assembly 30, at least in principal part, is formed by a seat cushion 32 supported by a raised pedestal 34. The raised pedestal 34 has an elongated shape and extends longitudinally along the center of the watercraft 10. The seat cushion 32 desirably is removably attached to a top surface of the pedestal 34 and covers the entire upper end of the pedestal for rider and passenger comfort.

An access opening (not shown) is located on an upper surface of the pedestal 34. The access opening opens into an engine compartment 38 formed within the hull 14. The seat cushion 32 normally covers and seals closed the access opening. When the seat cushion 32 is removed, the engine compartment 38 is accessible through the access opening.

The pedestal 34 also desirably includes at least one air duct located behind the access opening. The air duct communicates with the atmosphere through a space between the pedestal 34 and the cushion 32 which is formed behind the access opening. Air passes through the rear duct in both directions.

The upper deck section 18 of the hull 12 advantageously includes a pair of raised gunnels (not shown) positioned on opposite sides of the aft end of the upper deck assembly 18. The raised gunnels define a pair of foot areas that extend generally longitudinally and parallel to the sides of the pedestal 34. In this position, the operator and any passengers sitting on the seat assembly 30 can place their feet in the foot areas with the raised gunnels shielding the feet and lower legs of the riders. A non-slip (e.g., rubber) mat desirably covers the foot areas to provide increased grip and traction for the operator and the passengers.

The lower hull portion 16 principally defines the engine compartment 38. Except for the air ducts, the engine compartment 38 is normally substantially sealed so as to enclose an engine of the watercraft 10 from the body of water in which the watercraft is operated.

The lower hull 16 is designed such that the watercraft 10 planes or rides on a minimum surface area at the aft end of the lower hull 16 in order to optimize the speed and handling of the watercraft 10 when up on plane. For this purpose, the lower hull section generally has a V-shaped configuration formed by a pair of inclined section that extend outwardly from a keel line of the hull to the hull's side walls at a dead rise angle. The inclined sections also extend longitudinally from the bow toward the transom of the lower hull 14. The side walls are generally flat and straight near the stern of the lower hull and smoothly blend towards the longitudinal center of the watercraft at the bow. The lines of intersection between the inclined section and the corresponding side wall form the outer chines of the lower hull section.

Toward the transom of the watercraft, the incline sections of the lower hull 16 extend outwardly from a recessed channel or tunnel 42 that extends upward toward the upper deck portion 16. The tunnel 42 has a generally parallelepiped shape and opens through the rear of the transom 43 of the watercraft 10, as seen in FIG. 1.

In the illustrated embodiment, a jet pump unit 44 propels the watercraft 10. The jet pump unit 44 is mounted within the tunnel 42 formed on the underside of the lower hull section 16 by a plurality of bolt. An intake duct 48 of the jet pump unit 44 defines an inlet opening 50 that opens into a gullet 52. The gullet 52 leads to an impeller housing assembly 54 in which the impeller of the jet pump 44 operates. An impeller housing assembly 54 also acts as a pressurization chamber and delivers the water flow from the impeller housing to a discharge nozzle housing 58.

A steering nozzle 60 is supported at the downstream end of the discharge nozzle 58 by a pair of vertically extending pivot pins. In an exemplary embodiment, the steering nozzle 60 has an integral lever on one side that is coupled to the handlebar assembly 28 through, for example, a bowden-wire actuator, as known in the art. In this manner, the operator of the watercraft can move the steering nozzle 60 to effect directional changes of the watercraft 10.

A ride plate 62 covers a portion of the tunnel 42 behind the inlet opening 50 to enclose the pump assembly 54 and the nozzle assembly 60 within the tunnel 42. In this manner, the lower opening of the tunnel 42 is closed to provide a planing surface for the watercraft 10.

An impeller shaft 64 (schematically illustrated in FIG. 1) supports the impeller within the impeller housing 54. The aft end of the impeller shaft 64 is suitable supported and journalled within the compression chamber of the assembly 54 in a known manner. The impeller shaft 64 extends in the forward direction through a front wall of the tunnel 42.

An internal combustion engine 66 of the watercraft powers the impeller shaft 64 to drive the impeller of the jet pump unit 44. The engine 66 is positioned within the engine compartment 38 and is mounted primarily beneath the control mast 20. Vibration-absorbing engine mounts 68 secure the engine 66 to the lower hull portion 16 in a known manner. The engine 66 is mounted in approximately a central position in the watercraft 10.

In the illustrated embodiment, the engine 66 includes two in-line cylinders and operates on a two-stroke, crankcase compression principle. The engine 66 is positioned such that the row of cylinders lies parallel to a longitudinal axis of the watercraft 10, running from bow to stem. This engine type, however, is merely exemplary. Those skilled in the art will readily appreciate that the present fuel delivery system can be used with any of a variety of engine types having other number of cylinders, having other cylinder arrangements and operating on other combustion principles (e.g., four-stroke principle).

As best seen in FIG. 2, a cylinder block 70 and a cylinder head assembly 72 desirably form the cylinders of the engine 66. A piston reciprocates within each cylinder of the engine 66 and together the pistons drive an output shaft 76, such as a crankshaft, in a known manner. A connecting rod links the corresponding piston to the crankshaft 76. The corresponding cylinder bore, piston and cylinder head of each cylinder forms a variable-volume chamber, which at a minimum volume defines a combustion chamber.

The crankshaft 76 desirably is journalled with a crankcase, which in the illustrated embodiment is formed between a crankcase member 80 and a lower end of the cylinder block 70. Individual crankcase chambers of the engine are formed within the crankcase by dividing walls and sealing disks, and are sealed from one another with each crankcase chamber communicating with a dedicated variable-volume chamber. Each crankcase chamber also communicates with a charge former of an induction system through a check valve (e.g., a reed-type valve). The induction system receives fuel from the fuel tank 24 and produces the fuel charge which is delivered to the cylinders in a known manner. Because the internal details of the engine 66 and the induction system desirably are conventional, a further description of the engine construction is not believed necessary to understand and practice the invention.

The output shaft 76 carries a flywheel assembly 86 on a front end of the shaft at a position forward of the row of cylinders. The flywheel assembly 86 includes a flywheel magneto which forms part of a spark timing circuit, as known in the art. A cover is attached to the front end of the cylinder block 70 and cylinder head 72 to enclose the flywheel assembly 86.

As seen in FIG. 1, a coupling 90 interconnects the engine crankshaft 76 to the impeller shaft 64. A bearing assembly 92, which is secured to the bulkhead, supports the impeller shaft 64 behind the shaft coupling 90.

The propulsion unit 44 supplies cooling water through a conduit 94 to an engine cooling jacket. For this purpose, an outlet port is formed on the housing the pressurization chamber assembly 54 of the jet pump 44. The conduit 94 is coupled to the outlet port and extends to an inlet port to the engine water jacket. In the illustrated embodiment, the inlet port desirably lies at the lower rear end of the engine 66, either on the cylinder block 70 or on an exhaust manifold 96 of the engine which is attached to the cylinder block 70.

The engine cooling jacket extends through the exhaust manifold 96, through the cylinder block 70, about the cylinders, and through the cylinder head assembly 72. Either the cylinder head assembly 72 or the exhaust manifold 96 can includes a coolant discharge port through which the cooling water exits the engine 38 and thence flows through at least a portion of the exhaust system 12. In the illustrated embodiment, the discharge port is formed in the cylinder head assembly 72. A conduit 98 connects the discharge port to the exhaust system 12.

The personal watercraft 10 so far described represents only an exemplary watercraft on which the present exhaust system 12 can be employed. A further description of the personal watercraft 10 is not believed necessary for an understanding and an appreciation of the present exhaust system 12. The exhaust systems will now be described in detail.

The exhaust system 12 discharges exhaust byproducts from the engine 66 to the atmosphere and/or to the body of water in which the watercraft 10 is operated. As best seen in FIGS. 1 and 2, the exhaust system 12 includes the exhaust manifold 96 that is affixed to the side of the cylinder block 70 and which receives exhaust gases from the combustion chambers through exhaust ports in a well-known manner.

An outlet end of the exhaust manifold 96 communicates with a C-shaped pipe section 100. As best seen in FIG. 2, this C-pipe 100 includes an inner tube 102 that communicates directly with the discharge end of the exhaust manifold 96. An outer tube 104 surrounds the inner tube 102 to form a water jacket 106 between the inner and outer tubes 102, 104. In the illustrated embodiment, the water jacket 106 includes an inlet port that receives water from the conduit 98 to deliver water from the engine cooling jacket. In the alternative, the water jacket 106 can communicate directly with the discharge end of the water jacket formed in the exhaust manifold 96.

The outer tube 104 is formed by upper and lower sections 108, 110. A releasable coupling 112 connects together the sections 108, 110 so as to permit expansion and contraction between the sections and accommodate thermal variations. The coupling 112 tightly hold together the upper and lower sections 108, 110 to prevent leakage from the waterjacket 106.

The upper section 110 of the outer tube 104 includes a port 114 which communicates with a conduit 116. A portion of the coolant flow through the coolant jacket 106 flows into the conduit 116. The conduit 116 in turn communicates with at least one discharge line 118 in order to discharge the cooling water to the body of water in which the watercraft is operated. In the illustrated embodiment, as shown in FIG. 1, the discharge line 118 extends laterally between the sides of the watercraft and is connected to discharge ports 120 that lie on either side of the watercraft hull 14 to act as a telltale indicator, exhibiting proper function of the engine cooling system.

The outlet end of the C-pipe 100 communicates with an expansion chamber 122 via a flexible coupling 124. The coupling 124 interconnects these components 100, 122 to allow communication between the exhaust paths through the C-pipe 100 and the expansion chamber 122 and between the water jackets of the C-pipe 100 and the expansion chamber 122.

For this purpose, the flexible coupling 124 includes an inner tubular section 126 and an outer section 128. The inner tubular section 126 has a diameter at its upstream end that matches the diameter of the inner tube 102 of the C-pipe 100 and a diameter at its downstream end that matches the diameter of an inner shell of the expansion chamber 122. In the illustrated embodiment, the inner tubular section 126 increases in diameter in the downstream direction in order to form a smooth transition from the C-pipe inner tube 102 to the expansion chamber 122.

A sleeve 130 seals the abutting ends of the C-pipe inner tube 102 and the inner tubular section 126 of the coupling 124. Conventional clamps 132 attach the sleeve 130 onto the ends of these inner tubes 102, 126.

The outer section 128 of the flexible coupling 124 generally has a bell-mouth like shape and circumscribes the downstream end of the inner tubular section 126. A coolant passage 134 is formed between the outer section 128 and the inner tubular section 126.

As seen in FIG. 2, a downstream end of the C-pipe outer tube 104 fits over the smaller end of the coupling's outer section 128. A conventional clamp 136 secures this connection.

The expansion chamber 122 has a dual shell construction formed by an inner shell 138 which defines an expansion chamber volume. The inner shell 138 has a diameter at an inlet end of the expansion chamber 122 that generally matches the diameter of the downstream end of the flexible coupling inner tubular section 126.

An outer shell 140 is connected to the inner shell 138 and defines a cooling jacket 142 about the inner shell 138. The water jacket 142 of the expansion chamber 122 communicates with the water jacket 134 of the flexible coupling 124 to receive cooling water from the engine 66.

The exhaust system 12 also includes a catalytic device 144. The catalytic device 144 desirably includes a main catalyst 146 and a pre catalyst 148 that is located upstream from the main catalyst 146. The pre catalyst 148 facilitates the conversion of a portion of the exhaust gases into harmless gases (e.g., carbon dioxide and water). The main catalyst 146 lies within the exhaust gas flow through the exhaust system 12 at a position that mandates that all exhaust gases must pass through the main catalyst 146. Together the pre catalyst 148 and main catalyst 146 reduce the emissions of hydrocarbons and other exhaust byproducts (e.g., carbon monoxide and oxides of nitrogen) from the watercraft engine.

The pre catalyst 148 and main catalyst 146 are formed of a catalytic material, which is designed to render harmless either all or some of the exhaust byproducts. For example, the pre catalyst 148 and main catalyst 146 can be made of a metal catalyst material, such as, for example, platinum. The pre catalyst 148 and main catalyst 146, however, can be made of different types of catalytic materials for treating different exhaust byproducts or lubricant.

In the illustrated embodiment, the pre catalyst 148 is formed on an interior surface of a hollow cylindrical body or pipe section 150 within the exhaust system. The inner surface of the pipe section can be either treated or lined with a catalytic material 152 to form the pre catalyst 148.

The main catalyst 146, in the illustrated embodiment, takes the form of a honeycomb-type catalyst bed 154. An annular shell 156 desirably supports the catalyst bed 154. Both the annular shell 156 of the main catalyst 146 and the tube section 150 of the pre catalyst 148 can be formed of stainless steel or alumina, or of another suitable material, readily known to those skilled in the art.

In the embodiment of FIGS. 1 and 2, the catalytic device 144 is located in the expansion chamber 122. Both the pre catalyst 148 and the main catalyst 146 are located generally at the center of the flow path through the expansion chamber volume. In this manner, all exhaust gas flow through the expansion chamber 122 passes through the pre catalyst 148 and the main catalyst 146.

The tube section 150 of the pre catalyst 148 includes an annular flange 158 to support the tube section 150 at a concentric position within the expansion chamber 122 about the flow axis through the chamber. The annular flange 158 is interposed between the end of the flexible coupling 124 and the end of the expansion chamber 122. A plurality of bolts 160 hold these components 124, 122 together.

As seen in FIG. 2, the tube section 150 of the pre catalyst 148 also has a slightly smaller diameter than the diameters of the expansion chamber inner shell 138 and the downstream end of the flexible coupling inner section 126. As such, the end of the flexible coupling inner section 126 abuts annular flange 158 of the tube section 150. A gasket or another type of seal desirably lies between these abutting members to seal the exhaust path from the waterjacket.

The flange 158 that supports the tube section 150 of the pre catalyst includes at least one opening to allow water flow from the water jacket 134 of the flexible coupling 124 to the expansion chamber's water jacket 142. Alternatively, an auxiliary source of coolant can be supplied to the water jacket 142 about the expansion chamber 122.

The expansion chamber 122 also houses the main catalyst 146 at a location downstream of the pre catalyst 148. In this position, at least a portion of the pre and main catalysts 146, 148 lie above the upper end (e.g., the cylinder head assembly 72) of the engine 66. This position assists in preventing exposure of catalysts 146, 148 to a back flow of water in the exhaust system 12.

In the illustrated embodiment, an annular flange 162 supports the annular shell 156 of the main catalyst 146 within the expansion chamber volume. The flange 162 is held between upper and lower sections 164, 166 of the expansion chamber 122. Bolts 165 secure together the sections 164, 166 with the flange 162 interposed therebetween. Each section 164, 166 of the expansion chamber 122 includes the dual shell construction described above. The annular flange 162 also includes a plurality of apertures 168 which place the cooling jackets 134 of the upper and lower sections 164, 166 of the expansion chamber 122 in communication with each other.

The inner shells 138 of the upper and lower sections 164, 166 also include tapered diameter transition regions 170, 172, respectively. The upper section inner shell 138 includes a transition region 170 of a reducing diameter. The transition region 170 decreases the flow diameter through the expansion chamber 122 to the diameter of the annular shell 156 of the main catalyst 146. In this manner, the transition region 170 funnels the exhaust flow into the main catalyst 146. The annular flange 162 that supports the annular shell 156 within the inner shell 138 also prevents exhaust flow around the main catalyst bed 154.

The transition region 172 of the lower section inner shell 138 produces an increasing flow diameter from the main catalyst 146 into the flow passage through the lower section 166 of the expansion chamber 122. The arrangement of the transition regions 170, 172 on both sides of the main catalyst 146 assists flow through the expansion chamber 122 and reduces the flow restriction posed by the main catalyst 144.

The lower section 166 of the expansion chamber 122 includes a downwardly turned portion that terminates at a discharge end 174. As seen in FIG. 2, the inner shell 138 stops short of the outer shell 140 such that the water flow through the water jacket 142 merges with the exhaust gas flow through the expansion chamber volume at the discharge end 174.

The lower section 166 of the expansion chamber 122 also includes a discharge port 176. The discharge port 176 is positioned just up stream of the discharge end 174. In this position, a portion of the cooling water flowing through the expansion chamber water jacket 142 flows through a discharge line 178 rather than through the exhaust system 12.

With reference to FIG. 1, a flexible conduit 180 is connected to the discharge port 176. The conduit 180 extends toward the transom 43 of the watercraft 10 and is connected to the exhaust system 12 near a discharge end of the exhaust system 12. In this manner, a substantial portion of the cooling water is expelled overboard substantially independent of the exhaust system 12.

With reference to FIG. 1, a flexible pipe section 182 is connected to the discharge end 174 of the expansion chamber 122 and extends rearwardly along one side of the watercraft hull tunnel 42. The flexible conduit 182 connects to an inlet section of a water trap device 184. The water trap device 184 also lies within the watercraft hull 14 on the same side of the tunnel 42.

The water trap device 184 has a sufficient volume to retain water and to preclude the back flow of water to the expansion chamber 122 and the engine 66. Internal baffles within the water trap device 184 help control water flow through the exhaust system 12.

An exhaust pipe 186 extends from an outlet section of the water trap device 184 and wraps over the top of the tunnel 42 to a discharge end 188. The discharge end 188 desirably opens into the tunnel 42 or through the transom 43 of the watercraft 10 at an area that is close to or actually below the water level with the watercraft 10 floating at rest on the body of water.

Figure 3:
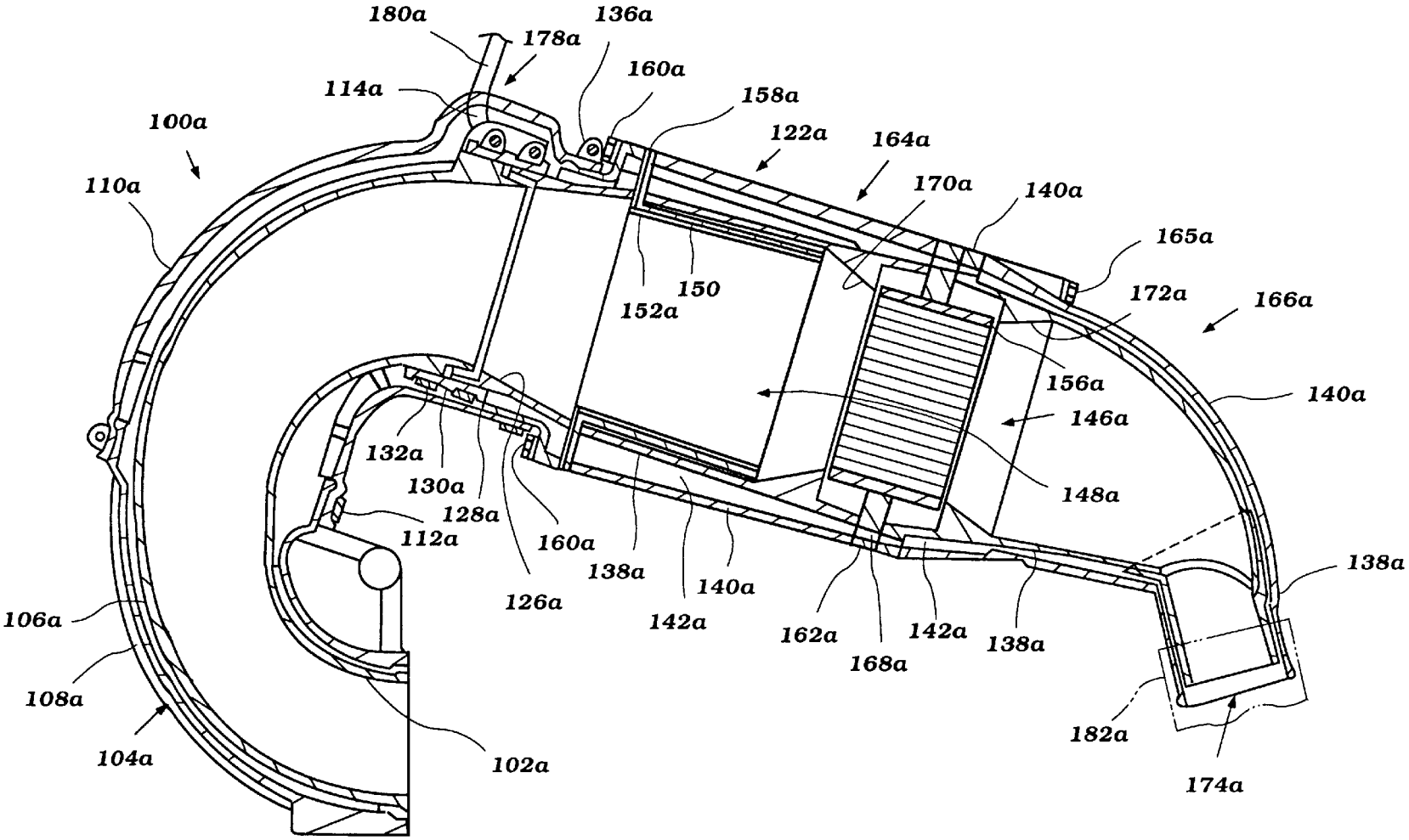
FIG. 3 is an enlarged cross-sectional view of a portion of an exhaust system configured in accordance with another preferred embodiment of the present invention.

FIG. 3 illustrate an exhaust system which is configured in accordance with another embodiment of the present invention. The exhaust system of the embodiment of FIG. 3 is substantially identical to that described above, except for the arrangement of the drain hoses that communicate with the exhaust system water jacket. To ease the reader's understanding of the present embodiment, like reference numerals with an "a" suffix are used to indicate similar parts of the two embodiments.

As seen in FIG. 3, a drain hose 180*a* is connected to the outlet port 114*a* on the C-pipe 100*a*. A substantial portion of the cooling water flows through the drain hose 180*a* and thence is expelled overboard. The balance of the cooling water flows through the water jacket 142*a* that surrounds the expansion chamber 122*a* and mixes with the exhaust gas flow downstream of the chamber 122*a*. In this manner, less water flows through the water jacket 142*a* of the expansion chamber 122*a* to allow the pre and main catalysts 146*a*, 148*a* to warm to an appropriate operating temperature quicker than the time the catalytic device of the previous embodiments takes to warm.

Figure 4:
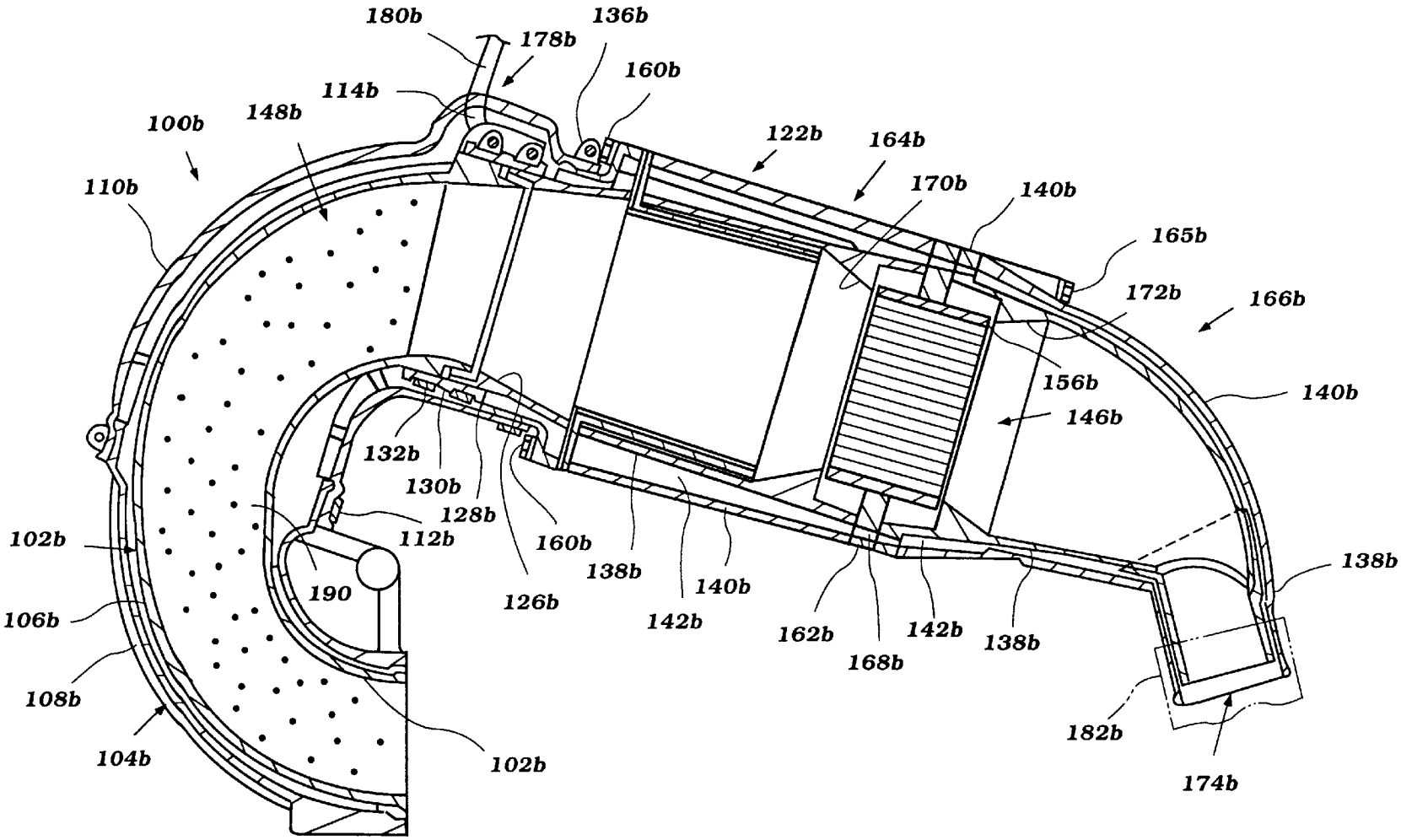
FIG. 4 is an enlarged cross-sectional view of a portion of an exhaust system configured in accordance with an additional embodiment of the present invention.
Figure 5:
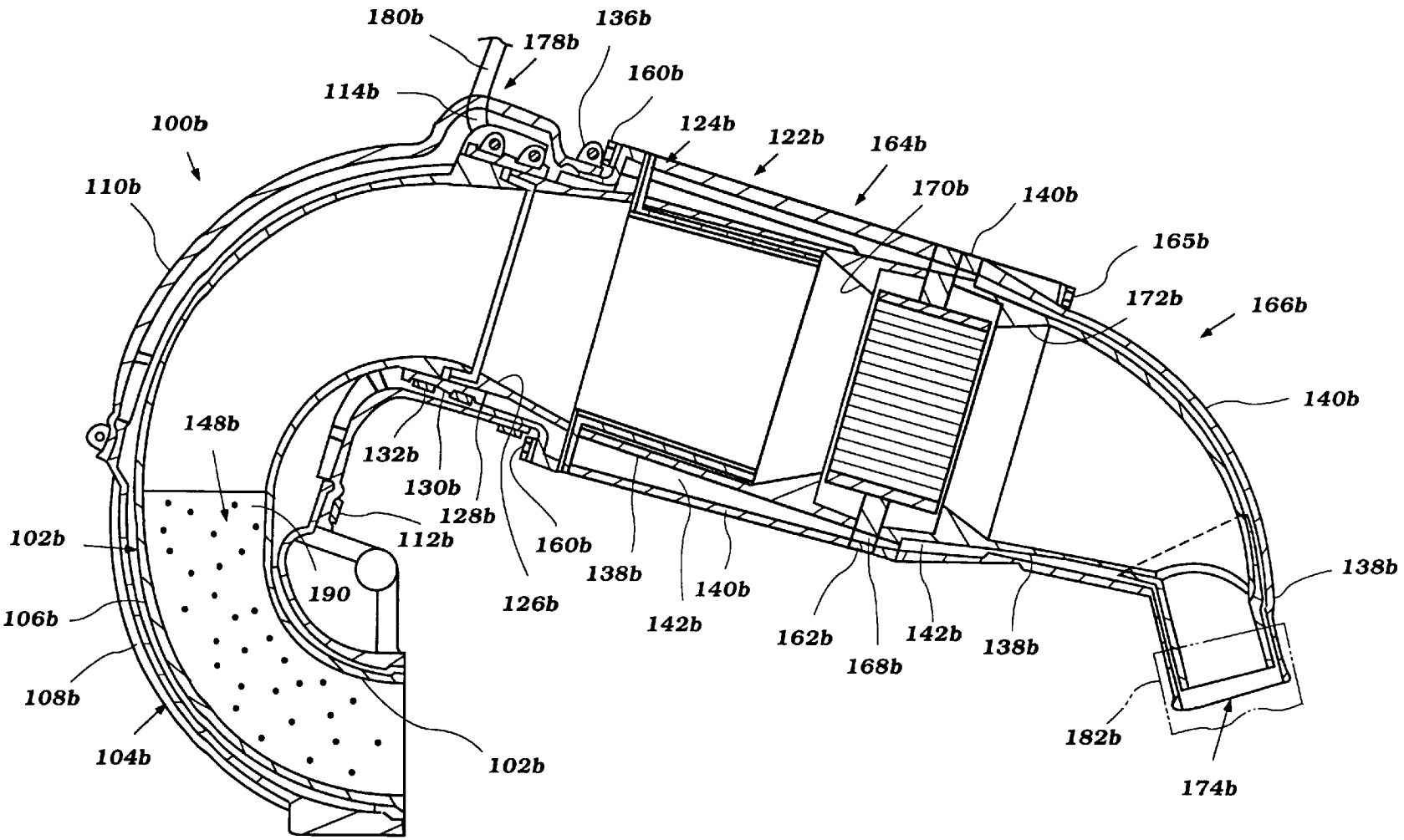
FIG. 5 is an enlarged cross-sectional view of a portion of an exhaust system configured in accordance with a further embodiment of the present invention.

FIGS. 4 and 5 illustrate an additional embodiments of the present exhaust system. Many of the components of the embodiments of these figures are similar to those described above in connection with the embodiment of FIGS. 2 and 3, and thus the above description should be understood as applying equal to the present embodiment, unless indicated to the contrary. For this purpose, like reference numerals with a "b" suffix are used in both FIGS. 4 and 5 to indicate like parts between the embodiments.

The catalytic device 144*b* of FIGS. 4 and 5 includes a main catalyst 146*b* positioned within the expansion chamber 122*b* and a pre catalyst 148*b* formed on at least portion of the inner wall of the C-pipe inner tube 102*b*. The inner wall 102*b* can either be treated or lined with the catalytic material 190 to forms the pre catalyst 148*b*. As seen in FIG. 4, the catalytic material 190 can completely coat the inner wall of the inner tube 102*b* or can coat only a portion of the inner wall. For instance, as illustrated in FIG. 5, the catalytic material coating 190 covers only a lower portion of the inner wall which lies near the exhaust manifold 98*b*.

FIGS. 4 and 5 also illustrate that the pre catalyst can be formed on any portion of the exhaust system upstream of the main catalyst. Thus, for instance, the pre catalyst can be formed on a portion of the inner wall of the expansion chamber inner shell that lies upstream of the main catalyst.

As common with all of the embodiments described above, the catalytic device provides a two-stage treatment of exhaust gases while minimizing flow restriction of through the exhaust system. The removal of a substantial portion of the cooling water before the merger point between the cooling water flow and the exhaust flow also reduces the chance of significant cooling water back-flow into the catalytic device so as to preserve the proper functioning of the catalytic device.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. A watercraft comprising an internal combustion engine having at least one exhaust port and an output shaft, a propulsion device driven by the engine output shaft, an exhaust system including an exhaust passage that extends between the engine exhaust port and a discharge port and a catalytic device to treat exhaust gases from the engine before discharge through the discharge port, the catalytic device including a main catalyst and a pre catalyst which is arranged within the exhaust passage apart from and upstream of the main catalyst and apart from and downstream of the engine, at least a principal portion of the main catalyst and the pre catalyst arranged above the engine exhaust port, and a cooling jacket extending along a portion of the exhaust system in the vicinity of the catalytic device, said cooling jacket opening into the exhaust passage at a point downstream of the main catalyst.

2. A watercraft as in claim 1 additionally comprising a conduit connected to the cooling jacket at a location upstream of the point at which the cooling jacket opens into the exhaust passage.

3. A watercraft as in claim 2, wherein said conduit is a primary conduit connected to the cooling jacket downstream of the main catalyst, whereby a portion of the coolant flow through the cooling jacket is discharged through the conduit.

4. A watercraft as in claim 3 additionally comprising an auxiliary conduit connected to the cooling jacket upstream of the primary conduit.

5. A watercraft as in claim 1, wherein said pre catalyst comprises a catalytic material coating on an inner surface of the exhaust passage.

6. A watercraft as in claim 5, wherein a tubular section forms a portion of the exhaust passage and the catalytic material coats an inner surface of the tube section.

7. A watercraft as in claim 6, wherein the tubular section has a curvilinear flow path through the tubular section.

8. A watercraft as in claim 1, wherein at least a portion of the catalyst and at least a portion of the pre catalyst lie above an upper end of the engine.

9. A watercraft as in claim 1, wherein the catalyst and pre catalyst are formed of the same catalytic metal.

10. A watercraft as in claim 1 additionally comprising a hull defining a rider's area sized to accommodate at least one rider, the hull also defining an engine compartment that contains the engine.

11. A watercraft as in claim 10, wherein the propulsion device is a jet propulsion device mounted onto the underside of the hull.

12. A watercraft as in claim 1 wherein the pre catalyst is apart from and downstream of an exhaust manifold.

13. A watercraft as in claim 1 wherein the pre catalyst is arranged substantially above the engine exhaust port.

14. A watercraft comprising an internal combustion engine having at least one exhaust port and an output shaft, a propulsion device driven by the engine output shaft, an exhaust system including an exhaust passage, that extends between the engine exhaust port and a discharge port, and a catalytic device to treat exhaust gases from the engine before discharge through the discharge port, the catalytic device including a main catalyst and a pre catalyst which is arranged within the exhaust passage apart from and upstream of the main catalyst, and a cooling jacket extending along a portion of the exhaust system in the vicinity of the catalytic device, said cooling jacket merging into the exhaust passage at a point downstream of the main catalyst and a conduit connected to the cooling jacket upstream of the main catalyst, whereby a portion of the coolant flow through the cooling jacket is discharged through the conduit.

15. A watercraft comprising an internal combustion engine having at least one exhaust port and an output shaft, a propulsion device driven by the engine output shaft, an exhaust system including an exhaust passage, that extends between the engine exhaust port and a discharge port, and a catalytic device to treat exhaust gases from the engine before discharge through the discharge port, the catalytic device including a main catalyst and a pre catalyst which is arranged within the exhaust passage apart from and upstream of the main catalyst, a cooling jacket extending along a portion of the exhaust system in the vicinity of the catalytic device, said cooling jacket merging into the exhaust passage at a point downstream of the main catalyst and a conduit connected to the cooling jacket upstream of a downstream end of the pre catalyst, whereby a portion of the coolant flow through the cooling jacket is discharged through the conduit.

16. A watercraft comprising an internal combustion engine having at least one exhaust port and an output shaft, a propulsion device driven by the engine output shaft, an exhaust system including an exhaust passage, that extends between the engine exhaust port and a discharge port, and a catalytic device to treat exhaust gases from the engine before discharge through the discharge port, the catalytic device including a main catalyst and a pre catalyst which is arranged within the exhaust passage apart from and upstream of the main catalyst, the pre catalyst including a hollow, cylindrical body positioned within the exhaust passage, an inner surface of the cylindrical body being coated with a catalytic material and a cooling jacket extending along a portion of the exhaust system in the vicinity of the catalytic device, said cooling jacket opening into the exhaust passage at a point downstream of the main catalyst.

17. A watercraft as in claim 16, wherein said cooling jacket extends along at least a portion of the exhaust passage in which the pre catalyst is located.

18. A watercraft as in claim 17 additionally comprising a drain hose connected to the cooling jacket at a point near to the position of the pre catalyst within the exhaust passage, whereby a portion of the coolant flowing through the cooling jacket is discharged overboard through the drain hose.

19. A watercraft as in claim 18, wherein said cooling jacket extends downstream of the pre catalyst.

20. A watercraft as in claim 18 additionally comprising at least one telltale port positioned on a side of a hull of the watercraft, and the drain hose communicates with the telltale port.

* * * * *